US009127675B2

(12) United States Patent
Sekiya et al.

(10) Patent No.: US 9,127,675 B2
(45) **Date of Patent: *Sep. 8, 2015**

(54) VANE COMPRESSOR WITH VANE ALIGNERS

(75) Inventors: Shin Sekiya, Tokyo (JP); Hideaki Maeyama, Tokyo (JP); Shinichi Takahashi, Tokyo (JP); Masahiro Hayashi, Tokyo (JP); Hirotsugu Hayashi, legal representative, Tokyo (JP); Tetsuhide Yokoyama, Tokyo (JP); Tatsuya Sasaki, Tokyo (JP); Hideto Nakao, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 212 days.

This patent is subject to a terminal disclaimer.

(21) Appl. No.: 13/701,057

(22) PCT Filed: Aug. 2, 2011

(86) PCT No.: PCT/JP2011/067648

§ 371 (c)(1),
(2), (4) Date: Nov. 30, 2012

(87) PCT Pub. No.: WO2012/023426

PCT Pub. Date: Feb. 23, 2012

(65) Prior Publication Data

US 2013/0149178 A1 Jun. 13, 2013

(30) Foreign Application Priority Data

Aug. 18, 2010 (JP) ..... 2010-182962

(51) Int. Cl.
*F04C 18/00* (2006.01)
*F04C 18/32* (2006.01)
(Continued)

(52) U.S. Cl.
CPC ..... *F04C 18/00* (2013.01); *F01C 21/0836* (2013.01); *F04C 18/321* (2013.01);
(Continued)

(58) Field of Classification Search
CPC ..... F01C 21/0809; F01C 21/0836; F01C 18/321; F01C 18/3441; F01C 18/352
USPC ..... 418/241, 259
See application file for complete search history.

(56) References Cited

U.S. PATENT DOCUMENTS 1,291,618 A 1/1919 Olson
1,339,723 A 5/1920 Smith
(Continued)

FOREIGN PATENT DOCUMENTS

GB 26718 A 0/1910
JP 52 47571 12/1977
(Continued)

OTHER PUBLICATIONS

International Search Report Issued Nov. 8, 2011 in PCT/JP11/67648 Filed Aug. 2, 2011.
(Continued)

*Primary Examiner* — Mary A Davis
(74) *Attorney, Agent, or Firm* — Oblon, McClelland, Maier & Neustadt, L.L.P.

(57) ABSTRACT

A vane compressor including plural vanes that perform a compression operation such that the normal to a circular arc formed by each vane tip portion and the normal to the inner peripheral surface of a cylinder are constantly approximately coincident with each other. Each of the plural vanes is held constantly in the normal direction of the inner peripheral surface of the cylinder or is held constantly along a direction having a fixed inclination with respect to the normal direction of the inner peripheral surface of the cylinder so that the compression operation is performed in the state the normal to the circular arc formed by the tip portion of each of the plural vanes and the normal to the inner peripheral surface of the cylinder are constantly approximately coincident with each other. The plural vanes are rotatably and movably supported with respect to a rotor portion.

13 Claims, 10 Drawing Sheets

(51) Int. Cl.

| | |
|---|---|
| ***F04C 23/00*** | (2006.01) |
| ***F04C 18/352*** | (2006.01) |
| ***F04C 18/344*** | (2006.01) |
| ***F04C 27/00*** | (2006.01) |
| ***F01C 21/08*** | (2006.01) |

(52) U.S. Cl.

CPC ..... *F04C18/352* (2013.01); *F04C 23/008* (2013.01); *F01C 21/0809* (2013.01); *F04C 18/3441* (2013.01); *F04C 27/001* (2013.01)

(56) References Cited

U.S. PATENT DOCUMENTS

| | | | |
|---|---|---|---|
| 1,444,269 | A | 2/1923 | Piatt |
| 2,044,873 | A | 6/1936 | Beust |
| 4,410,305 | A | 10/1983 | Shank et al. |
| 4,657,491 | A | 4/1987 | Frank |
| 4,955,985 | A | 9/1990 | Sakamaki et al. |
| 4,958,995 | A | 9/1990 | Sakamaki et al. |
| 4,997,351 | A | 3/1991 | Sakamaki et al. |
| 4,997,353 | A | 3/1991 | Sakamaki et al. |
| 4,998,867 | A | 3/1991 | Sakamaki et al. |
| 4,998,868 | A | 3/1991 | Sakamaki et al. |
| 5,002,473 | A | 3/1991 | Sakamaki et al. |
| 5,011,390 | A | 4/1991 | Sakamaki et al. |
| 5,022,842 | A | 6/1991 | Sakamari et al. |
| 5,030,074 | A | 7/1991 | Sakamaki et al. |
| 5,032,070 | A | 7/1991 | Sakamaki et al. |
| 5,033,946 | A | 7/1991 | Sakamaki et al. |
| 5,044,910 | A | 9/1991 | Sakamaki et al. |
| 5,087,183 | A | 2/1992 | Edwards |
| 5,160,252 | A | 11/1992 | Edwards |
| 5,536,153 | A | 7/1996 | Edwards |
| 6,193,906 | B1 | 2/2001 | Kaneko et al. |
| 6,223,554 | B1 | 5/2001 | Adachi |
| 8,602,760 | B2 | 12/2013 | Maeyama et al. |
| 2013/0064705 | A1 | 3/2013 | Sekiya et al. |

FOREIGN PATENT DOCUMENTS

| | | |
|---|---|---|
| JP | 55 139993 | 11/1980 |
| JP | 58 70087 | 4/1983 |
| JP | 58 197493 | 11/1983 |
| JP | 60 256583 | 12/1985 |
| JP | 61 132793 | 6/1986 |
| JP | 63 73593 | 5/1988 |
| JP | 6 501758 | 2/1994 |
| JP | 10 252675 | 9/1998 |
| JP | 2000 352390 | 12/2000 |
| JP | 2001 115979 | 4/2001 |

OTHER PUBLICATIONS

U.S. Office Action mailed Aug. 14, 2014 in co-pending U.S. Appl. No. 13/700,634.

Japanese Office Action issued Oct. 29, 2013 in Patent Application No. 2012-529553 with Partial English Translation.

Extended European Search Report issued Jun. 17, 2014 in Patent Application No. 11818068.6.

Extended European Search Report issued Jun. 17, 2014 in Patent Application No. 11818070.2.

Office Action Issued Jan. 23, 2015 in co-pending U.S. Appl. No. 13/700,634.

VANE COMPRESSOR WITH VANE ALIGNERS

TECHNICAL FIELD

The present invention relates to a vane compressor.

BACKGROUND ART

Conventionally, a common vane compressor is proposed (refer to, e.g., Patent Literature 1). The vane compressor has a structure in which a vane is fitted in a vane groove formed at one location or each of a plurality of locations in a rotor portion of a rotor shaft (unitary formation of the columnar rotor portion that rotates within a cylinder and a shaft that transmits torque to the rotor portion being referred to as the rotor shaft), and a vane tip slides while contacting the inner peripheral surface of the cylinder.

A different vane compressor is proposed (refer to, e.g., Patent Literature 2). In the vane compressor, an inside of a rotor shaft is formed to be hollow, and a fixed shaft for vanes is disposed in the inside of the rotor shaft. The vanes are rotatably attached to the fixed shaft. Further, each vane is held rotatably with respect to a rotor portion through a pair of semicircular-bar-shaped supporting members in the vicinity of an outer peripheral part of the rotor portion.

CITATION LIST

Patent Literature

Patent Literature 1: JP 10-252675 A (Page 4 and FIG. 1)
Patent Literature 2: JP 2000-352390 A (Page 6 and FIG. 1)

SUMMARY OF INVENTION

Technical Problem

In the conventional common vane compressor (e.g., Patent Literature 1), the direction of the vane is restricted by the vane groove formed in the rotor portion of the rotor shaft. The vane is held to constantly have the same inclination with respect to the rotor portion. Therefore, an angle formed between the vane and the inner peripheral surface of the cylinder changes along with rotation of the rotor shaft. Thus, it is necessary to form the radius of a circular arc formed by the vane tip to be smaller than the radius of the inner peripheral surface of the cylinder in order for the vane tip to make contact with all around the inner peripheral surface of the cylinder.

In the vane compressor where the vane tip slides while contacting the inner peripheral surface of the cylinder, the vane tip having a greatly different radius from that of the inner peripheral surface slides. Thus, between the two components (the cylinder and the vane), a fluid lubrication state, in which an oil film is formed and the vane tip slides through the oil film, does not occur but rather a boundary lubrication state occurs. Generally, while a friction coefficient of a lubrication state is around 0.001 to 0.005 in the fluid lubrication state, the friction coefficient greatly increases to be approximately 0.05 or more in the boundary lubrication state.

In the structure of the conventional common vane compressor, the vane tip slides on the inner peripheral surface of the cylinder in the boundary lubrication state. Sliding resistance is therefore high, leading to a great reduction of the compressor efficiency due to an increase in machine loss. There is also a problem that the vane tip and the inner peripheral surface of the cylinder tend to abrade to make it difficult to ensure long life of the vane and the cylinder. Then, the conventional vane compressor has been so designed that a pressing force of the vane against the inner peripheral surface of the cylinder is reduced as much as possible.

As a mode for improving the above-mentioned problems, there has been proposed a method (e.g., Patent Literature 2). In this method, the inside of the rotor portion is formed to be hollow. Then, the fixed shaft for rotatably supporting the vanes at the center of the inner peripheral surface of the cylinder is provided in the inside. Further, each vane is held through the supporting members in the vicinity of the outer peripheral part of the rotor portion so that each vane is rotatable with respect to the rotor portion.

With this arrangement, the vanes are rotatively supported at the center of the inner peripheral surface of the cylinder. Therefore, the vane longitudinal direction constantly coincides with the normal direction of the inner peripheral surface of the cylinder. The radius of the inner peripheral surface of the cylinder and the radius of a circular arc formed by each vane tip may be therefore formed to be approximately equal to each other so that each vane tip portion is along the inner peripheral surface of the cylinder. Each vane tip and the inner peripheral surface of the cylinder may be therefore formed not to be in contact with each other. Alternatively, even if the vane tip and the inner peripheral surface of the cylinder contact with each other, a fluid lubrication state with a sufficient film may be produced. The sliding state of each vane tip portion, which is the problem of the conventional vane compressor, may be thereby improved.

In the method of Patent Literature 2, however, the inside of the rotor portion is formed to be hollow, thus making it difficult to provide torque to the rotor portion or to rotatively support the rotor portion. In Patent Literature 2, end plates are provided at both end surfaces of the rotor portion. As the end plate on one side needs to transmit power from the rotary shaft, the end plate on the one side is in the shape of a disk, and the rotary shaft is connected to the center of the end plate. The end plate on the other side needs to be formed not to interfere with rotation ranges of the vane fixed shaft and the vane axis support member. Thus, it is necessary to form the end plate on the other side to be in the shape of a ring with a hole opened at the center portion thereof. Therefore, it is necessary to form a portion for rotatively supporting each end plate to have a diameter larger than that of the rotary shaft, causing a problem that bearing sliding loss increases.

A space formed between the rotor portion and the inner peripheral surface of the cylinder is narrow so that compressed air does not leak. High precision is therefore required for the outer diameter and the rotation center of the rotor portion. The rotor portion and the end plates are, however, formed of separate components. Thus, there is a problem that a distortion which may occur by fastening the rotor portion to the end plates, a coaxial gap between the rotor portion and the end plates, or the like may lead to degradation of precision of the outer diameter or the rotation center of the rotor portion.

The present invention has been made in order to solve the problems as described above, and provides a vane compressor which will be described below.

(1) Firstly, a vane compressor that, in order to reduce bearing sliding loss of a rotary shaft and reduce gas leakage loss by narrowing a space formed between a rotor portion and the inner peripheral surface of a cylinder, includes a plurality of vanes in which, a mechanism where the vanes rotate about the center of the cylinder, the mechanism being necessary for performing a compression operation such that the normal to a circular arc formed by each vane tip portion and the normal to the inner peripheral surface of the cylinder are constantly approximately coincident with each other, is implemented by unitarily forming the rotor portion and the rotary shaft. This mechanism is implemented without using, for the rotor portion, end plates that may degrade precision of the outer diameter or the rotation center of the rotor portion.

(2) Secondly, a vane compressor in which, by applying the above-mentioned mechanism, gas leakage from a space between each vane tip portion and the inner peripheral surface of the cylinder is minimized while keeping each vane tip portion from being in contact with the inner peripheral surface of the cylinder.

(3) Thirdly, a vane compressor in which, while achieving the above-mentioned mechanism, another mechanism where the vanes are rotatable and movable in the rotor portion is implemented by a method for enabling sliding in a fluid lubrication state.

Solution to Problem

A vane compressor according to the present invention includes:

an approximately cylindrical cylinder whose both axial ends are open;

a cylinder head and a frame that close the both axial ends of the cylinder;

a rotor shaft including a columnar rotor portion that rotates in the cylinder and a shaft portion that transmits torque to the rotor portion; and a plurality of vanes installed in the rotor portion, each of the plurality of vanes having a tip portion formed into a circular arc shape facing outward, wherein each of the plurality of vanes is held to be constantly in a normal direction of an inner peripheral surface of the cylinder or is held to constantly have a fixed inclination with respect to the normal direction of the inner peripheral surface of the cylinder so that a compression operation is performed in a state where a normal to the circular arc shape formed by the tip portion of each of the plurality of vanes and a normal to the inner peripheral surface of the cylinder are constantly approximately coincident with each other, the plurality of vanes are rotatably and movably supported with respect to the rotor portion in the rotor portion, a concave portion or a ring-shaped groove being concentric with an inner diameter of the cylinder is formed in an end surface of each of the cylinder head and the frame on a side of the cylinder, a pair of vane aligners are fitted in the concave portion or the ring-shaped groove, each of the vane aligners including a plate-like projection or a groove at a partial-ring-shaped end surface thereof, and the plate-like projection or the groove is fitted in a groove or a projection provided at each of the plurality of vanes.

Advantageous Effects of Invention

In the vane compressor according to the present invention, by unitarily forming the rotor portion and the rotary shaft, a mechanism where the vanes rotate about the center of the cylinder, the mechanism being necessary for performing a compression operation such that the normal to a circular arc formed by each vane tip portion and the normal to the inner peripheral surface of the cylinder are constantly approximately coincident with each other, can be implemented. Bearing sliding loss can be therefore reduced by supporting the rotary shaft by bearings having a small diameter. Further, precision of the outer diameter or the rotation center of the rotor portion is improved. A space formed between the rotor portion and the inner peripheral surface of the cylinder can be thereby narrowed to reduce gas leakage loss.

DESCRIPTION OF EMBODIMENTS

First Embodiment

Figure 1:
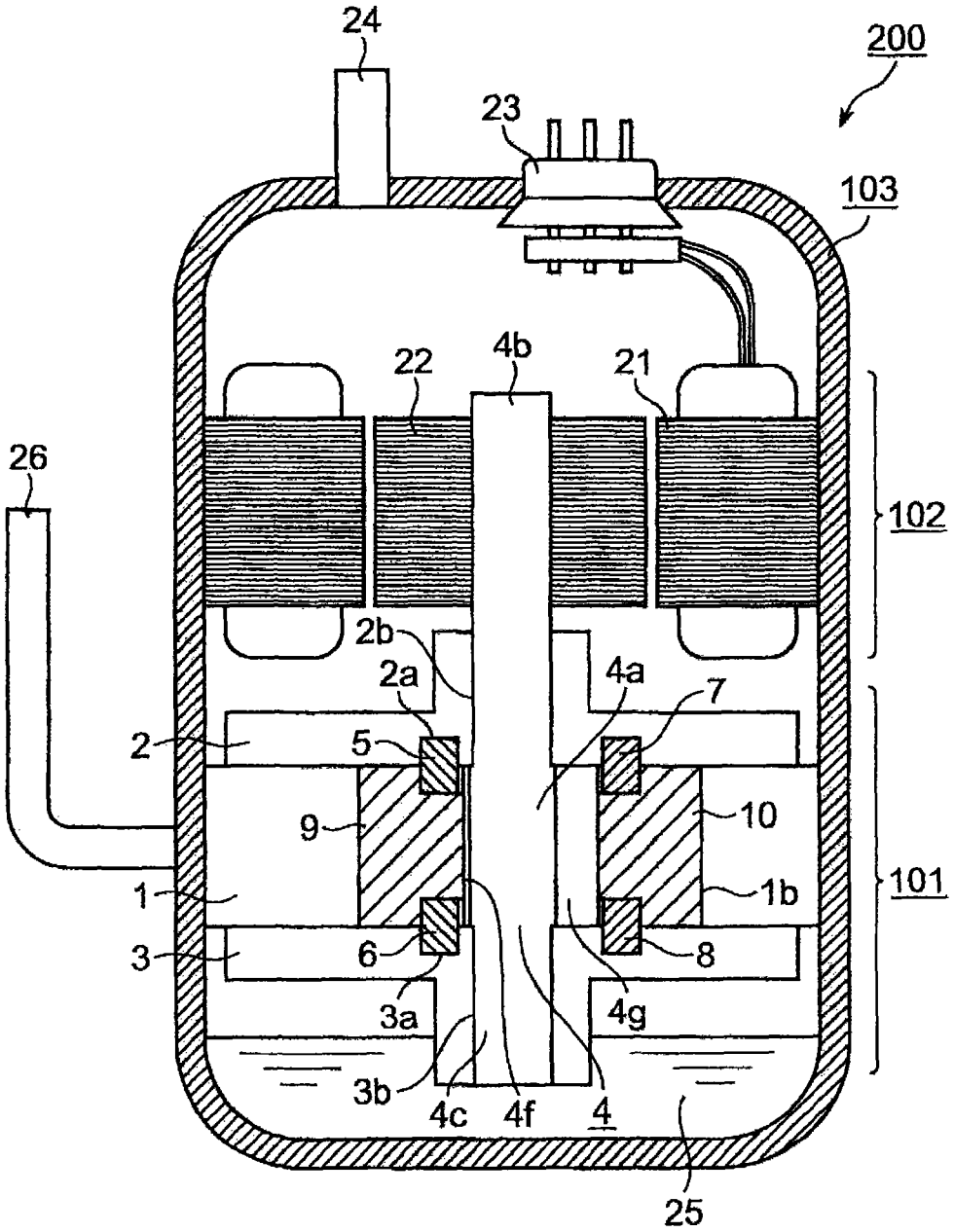
FIG. 1 a diagram showing a first embodiment, which is a longitudinal sectional view of a vane compressor 200.

FIG. 1 is a diagram showing a first embodiment, and is a longitudinal sectional view of a vane compressor 200. The vane compressor 200 (hermetic type) will be described, with reference to FIG. 1. This embodiment is, however, characterized by a compression element 101, and the vane compressor 200 (hermetic type) is an example. This embodiment is not limited to the hermetic type, and is also applied to a different type such as an engine-driven type and an open container type.

The compression element 101 and an electric motor element 102 for driving this compression element 101 are stored in a hermetic container 103 in the vane compressor 200 (hermetic type) shown in FIG. 1. The compression element 101 is located in the lower portion of the hermetic container 103 and guides refrigerant oil 25 stored in the bottom portion of the hermetic container 103 to the compression element 101 by a lubrication mechanism not shown, thereby lubricating each sliding portion of the compression element 101.

The electric motor element 102 for driving the compression element 101 is composed of a brushless DC motor, for example. The electric motor element 102 includes a stator 21 fixed to an inner periphery of the hermetic container 103 and a rotor 22 that is disposed inside the stator 21 and uses a permanent magnet. Electric power is supplied to the stator 21 from a glass terminal 23 fixed to the hermetic container 103 by welding.

The compression element 101 sucks a refrigerant of a low-pressure into a compression chamber from a suction portion 26 and compresses the sucked refrigerant. The compressed refrigerant is discharged in the hermetic container 103, passes through the electric motor element 102, and is then discharged to an outside (high-pressure side of a refrigerating cycle) from a discharge pipe 24 fixed to (welded at) the upper portion of the hermetic container 103. The vane compressor 200 (hermetic type) may be either a high-pressure type compressor of high pressure inside the hermetic container 103, or a low-pressure type compressor of low pressure inside the hermetic container 103. This embodiment shows a case where the number of vanes (which are a first vane 9 and a second vane 10 in FIG. 1) is two.

Figure 2:
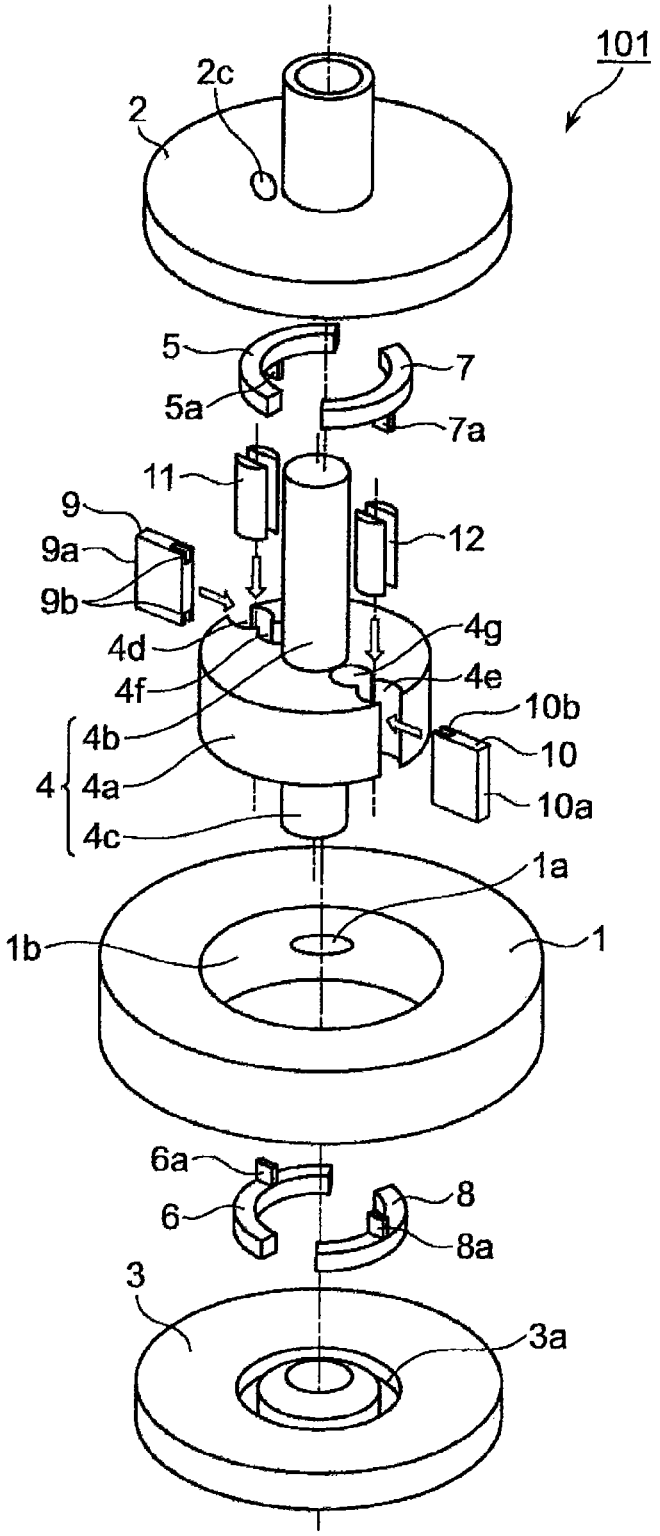
FIG. 2 a diagram showing the first embodiment, which is an exploded perspective view of a compression element 101 of the vane compressor 200.
Figure 3:
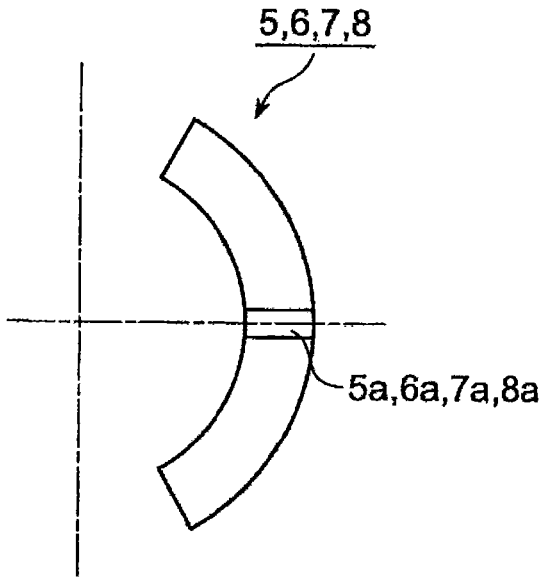
FIG. 3 a diagram showing the first embodiment, which is a plan view of each of vane aligners 5, 6, 7, and 8.

Since this embodiment is characterized by the compression element 101, the compression element 101 will be described below in detail. Although a reference symbol is assigned to each component constituting the compression element 101 in FIG. 1 as well, the exploded perspective view of FIG. 2 is easier to understand, and thus a description will be given mainly with reference to FIG. 2. FIG. 2 is a diagram showing the first embodiment, and is the exploded perspective view of the compression element 101 of the vane compressor 200. FIG. 3 is a diagram showing the first embodiment, and is a plan view of each of vane aligners 5, 6, 7, and 8.

As shown in FIG. 2, the compression element 101 includes elements that will be described below.

(1) Cylinder 1: The whole shape of the cylinder 1 is approximately cylindrical, and both axial end portions of the cylinder 1 are open. A suction port 1*a* is open in an inner peripheral surface 1*b* of the cylinder 1.

(2) Frame 2: The frame 2 has a longitudinal section approximately in the shape of a letter T. A portion of the frame 2 contacting the cylinder 1 is approximately in the shape of a disk, and closes one opening portion (on the upper side of the cylinder 1 in FIG. 2) of the cylinder 1. A vane aligner holding portion 2*a* (shown in FIG. 1 alone), which is in the shape of a ring groove being concentric with the inner peripheral surface 1*b* of the cylinder 1, is formed in an end surface of the frame 2 on the side of the cylinder 1. The vane aligners 5 and 7, which will be described later, are fitted in this vane aligner holding portion 2*a*. The frame 2 has a cylindrically hollow central portion, at which a bearing portion 2*b* (shown in FIG. 1 alone) is provided. A discharge port 2*c* is formed in approximately the central portion of the frame 2.

(3) Cylinder Head 3: The cylinder head 3 has a longitudinal section approximately in the shape of a letter T (refer to FIG. 1). A portion of the cylinder head 3 contacting the cylinder 1 is approximately in the shape of a disk, and closes the other opening portion (on the lower side of the cylinder 1 in FIG. 2) of the cylinder 1. A vane aligner holding portion 3*a*, which is in the shape of a ring groove being concentric with the inner peripheral surface 1*b* of the cylinder 1, is formed in an end surface of the cylinder head 3 on the side of the cylinder 1. The vane aligners 6 and 8 are fitted in this vane aligner holding portion 3*a*. The cylinder head 3 has a cylindrically hollow central portion, at which a bearing portion 3*b* (shown in FIG. 1 alone) is provided.

(4) Rotor Shaft 4: The rotor shaft 4 has a structure in which a rotor portion 4*a*, upper and lower rotary shaft portions 4*b* and 4*c* are unitarily formed. The rotor portion 4*a* rotates inside the cylinder 1 about a central axis that is eccentric to the central axis of the cylinder 1. The rotary shaft portions 4*b* and 4*c* are respectively supported by the bearing portion 2*b* of the frame 2 and the bearing portion 3*b* of the cylinder head 3. Bush holding portions 4*d* and 4*e* and vane relief portions 4*f* and 4*g* each having an approximately circular cross-section and penetrating in the axial direction are formed in the rotor portion 4*a*. The bush holding portion 4*d* and the vane relief portion 4*f* are communicated, and the bush holding portion 4*e* and the vane relief portion 4*g* are communicated. The bush holding portion 4*d* and the bush holding portion 4*e* are disposed at substantially symmetrical positions, and the vane relief portion 4*f* and the vane relief portion 4*g* are disposed at substantially symmetrical positions (refer to FIG. 4 as well, which will be described later).

(5) Vane Aligners 5 and 7: Each of the vane aligners 5 and 7 is a partial-ring-shaped component. A vane holding portion 5*a*, which is a quadrangular plate-like projection, is installed upright on one of axial end surfaces (on the lower side in FIG. 2) of the vane aligner 5. A vane holding portion 7*a*, which is a quadrangular plate-like projection, is installed upright on one of axial end surfaces (on the lower side in FIG. 2) of the vane aligner 7. Each of the vane holding portions 5*a* and 7*a* is formed in the normal direction of the circular arc of the partial ring (refer to FIG. 3).

(6) Vane Aligners 6 and 8: Each of the vane aligners 6 and 8 is a partial-ring-shaped component. A vane holding portion 6*a*, which is a quadrangular plate-like projection, is installed upright on one of axial end surfaces (on the upper side in FIG. 2) of the vane aligner 6. A vane holding portions 8*a*, which is a quadrangular plate-like projection, is installed upright on one of axial end surfaces (on the upper side in FIG. 2) of the vane aligner 8. Each of the vane holding portions 6*a* and 8*a* is formed in the normal direction of the circular arc of the partial ring (refer to FIG. 3).

(7) First Vane 9: The first vane 9 is in the shape of an approximately quadrangular plate. A tip portion 9*a* located on the side of the inner peripheral surface 1*b* of the cylinder 1 is formed into a circular arc shape facing outward, and the radius of the circular arc shape is formed to be approximately equal to the radius of the inner peripheral surface 1*b* of the cylinder 1. Slit-like back side grooves 9*b* are formed in the back side of the first vane 9 which is opposite to the inner peripheral surface 1*b* of the cylinder 1, over the fitting length of the vane holding portion 5*a* of the vane aligner 5 and over the fitting length of the vane holding portion 6*a* of the vane aligner 6. The back side grooves 9*b* may be provided as one over the entire axial length of the first vane 9.

(8) Second Vane 10: The second vane 10 is in the shape of an approximately quadrangular plate. A tip portion 10*a* located on the side of the inner peripheral surface 1*b* of the cylinder 1 is formed into a circular arc shape facing outward, and the radius of the circular arc shape is formed to be approximately equal to the radius of the circle formed by the inner peripheral surface 1*b* of the cylinder 1. Slit-like back side grooves 10*b* are formed in the back side of the second vane 10 which is opposite to the inner peripheral surface 1*b* of the cylinder 1, over the fitting length of the vane holding portion 7*a* of the vane aligner 7 and over the fitting length of the vane holding portion 8*a* of the vane aligner 8. The back side grooves 10*b* may be provided as one over the entire axial length of the second vane 10.

(9) Bushes 11 and 12: A pair of the bushes 11 are each formed into an approximately semicolumnar shape. The pair of the approximately semicolumnar bushes 11 are fitted in the bush holding portion 4*d* of the rotor shaft 4. The plate-like first vane 9 is held inside the bushes 11 so that the first vane 9 may rotate and move in an approximately centrifugal direction (centrifugal direction from the center of the inner peripheral surface 1*b* of the cylinder 1) with respect to the rotor portion 4*a*. A pair of the bushes 12 are each formed into an approximately semicolumnar shape. The pair of the approximately semicolumnar bushes 12 are fitted in the bush holding portion 4*e* of the rotor shaft 4. The plate-like second vane 10 is held inside the bushes 12 so that the second vane 10 may rotate and move in the approximately centrifugal direction (centrifugal direction from the center of the inner peripheral surface 1*b* of the cylinder 1) with respect to the rotor portion 4*a*.

The vane holding portions 5*a* and 6*a* of the vane aligners 5 and 6 are fitted in the back side grooves 9*b* of the first vane 9, and the vane holding portions 7*a* and 8*a* of the vane aligners 7 and 8 are fitted in the back side grooves 10*b* of the second vane 10. The directions of the first vane 9 and the second vane 10 are thereby restricted such that the normal to the circular arc formed by the tip of each of the first vane 9 and the second vane 10 and the normal to the inner peripheral surface 1*b* of the cylinder 1 are constantly coincident with each other.

Operations will now be described. The rotary shaft portion 4*b* of the rotor shaft 4 receives rotative power from a driving portion of the electric motor element 102 or the like (or engine in the case of the engine-driven type), so that the rotor portion 4*a* rotates in the cylinder 1. Along with rotation of the rotor portion 4*a*, the bush holding portions 4*d* and 4*e* disposed in the vicinity of the outer periphery of the rotor portion 4*a* move on the circumference of a circle centering on the rotary shaft portion 4*b* of the rotor shaft 4. Then, the pair of bushes 11 held in the bush holding portion 4*d* and the pair of bushes 12 held in the bush holding portion 4*e*, the first vane 9 rotatably held in the pair of bushes 11, and the second vane 10 rotatably held in the pair of bushes 12 also rotate together with the rotor portion 4*a*.

The plate-like vane holding portion 5*a* (projecting portion) of the partial-ring-shaped vane aligner 5 and the plate-like vane holding portion 6*a* (projecting portion) of the partial-ring-shaped vane aligner 6 are slidably fitted in the back side grooves 9*b* formed in the back side of the first vane 9, so that the orientation of the first vane 9 (the vane longitudinal orientation) is restricted in the normal direction of the inner peripheral surface 1*b* of the cylinder 1. The vane aligner 5 is rotatably fitted in the vane aligner holding portion 2*a* (in FIG. 1) that is formed in the end surface of the frame 2 on the side of the cylinder 1, being concentric with the inner peripheral surface 1*b* of the cylinder 1. The vane aligner 6 is rotatably fitted in the vane aligner holding portion 3*a* (in FIGS. 1 and 2) that is formed in the end surface of the cylinder head 3 on the side of the cylinder 1, being concentric with the inner peripheral surface 1*b* of the cylinder 1.

The plate-like vane holding portion 7*a* (projecting portion) of the partial-ring-shaped vane aligner 7 and the plate-like vane holding portion 8*a* (projecting portion) of the partial-ring-shaped vane aligner 8 are slidably fitted in the back side grooves 10*b* formed in the back side of the second vane 10, so that the orientation of the second vane 10 (the vane longitudinal orientation) is restricted in the normal direction of the inner peripheral surface 1*b* of the cylinder 1. The vane aligner 7 is rotatably fitted in the vane aligner holding portion 2*a* (in FIG. 1) that is formed in the end surface of the frame 2 on the side of the cylinder 1, being concentric with the inner peripheral surface 1*b* of the cylinder 1. The vane aligner 8 is rotatably fitted in the vane aligner holding portion 3*a* (in FIGS. 1 and 2) that is formed in the end surface of the cylinder head 3 on the side of the cylinder 1, being concentric with the inner peripheral surface 1*b* of the cylinder 1.

The first vane 9 is pressed in the direction of the inner peripheral surface 1*b* of the cylinder 1 due to a pressure difference between the tip portion 9*a* and the back side grooves 9*b* (when the vane compressor 200 has a structure in which the refrigerant of a high pressure or an intermediate pressure is guided to a back side space of the first vane 9), a spring (not shown), a centrifugal force, or the like. Then, the tip portion 9*a* of the first vane 9 slides along the inner peripheral surface 1*b* of the cylinder 1. During this sliding of the tip portion 9*a*, the radius of the circular arc formed by the tip portion 9*a* of the first vane 9 is approximately equal to the radius of the inner peripheral surface 1*b* of the cylinder 1, and the normal to the circular arc formed by the tip portion 9*a* of the first vane 9 and the normal to the inner peripheral surface 1*b* of the cylinder 1 are substantially coincident with each other. Thus, a sufficient oil film is formed between the tip portion 9*a* of the first vane 9 and the inner peripheral surface 1*b* of the cylinder 1 to produce a fluid lubrication state. The same also holds true for the second vane 10.

Figure 4:
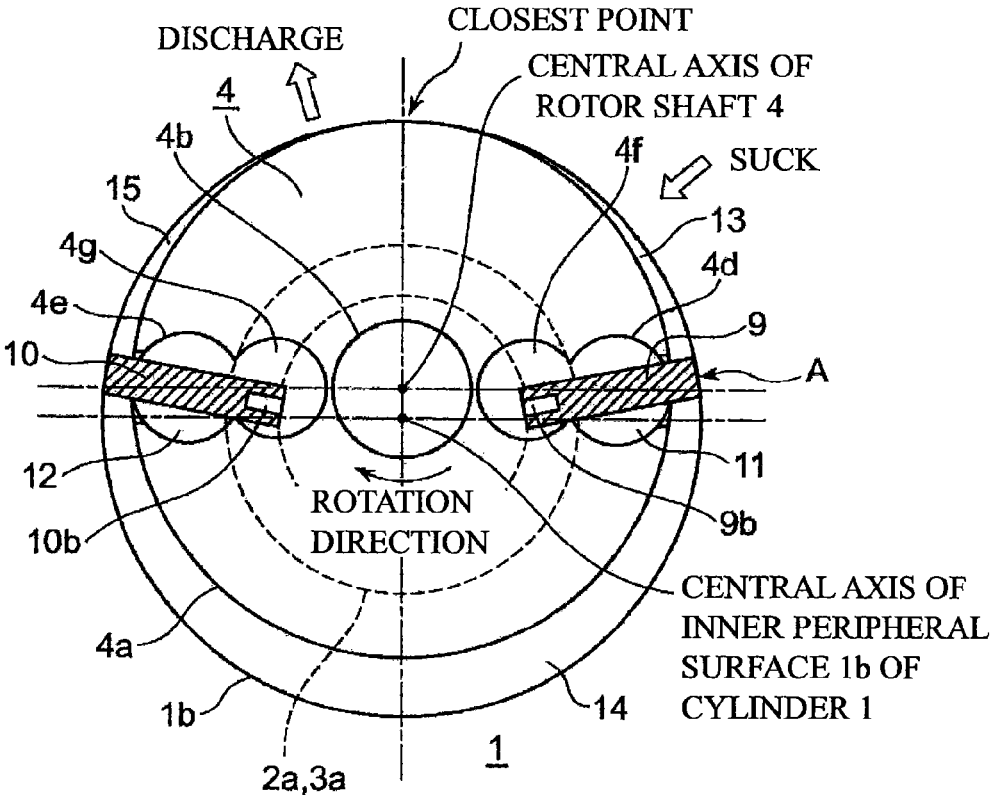
FIG. 4 a diagram showing the first embodiment, which is a plan view (90-degree rotation angle) of the compression element 101 of the vane compressor 200.

The compression principle of the vane compressor 200 in this embodiment is approximately similar to that of a conventional vane compressor. FIG. 4 is a diagram showing the first embodiment, and is a plan view (90-degree rotation angle) of the compression element 101 of the vane compressor 200. As shown in FIG. 4, the rotor portion 4*a* of the rotor shaft 4 and the inner peripheral surface 1*b* of the cylinder 1 are closest at one location (which is the closest point shown in FIG. 4).

Further, the first vane 9 slides on the inner peripheral surface 1*b* of the cylinder 1 at one location, and the second vane 10 slides on the inner peripheral surface 1*b* of the cylinder 1 at one location. Three spaces (which are a suction chamber 13, an intermediate chamber 14, and a compression chamber 15) are thereby formed in the cylinder 1. The suction port 1*a* (communicated with a low-pressure side of the refrigerating cycle) is open to the suction chamber 13. The compression chamber 15 is communicated with the discharge port 2*c* (which is formed in the frame 2, for example, but which may be formed in the cylinder head 3) that is closed by a discharge valve not shown except when discharging is performed. The intermediate chamber 14 is communicated with the suction port 1*a* up to a certain rotation angle range. Then, there is a rotation angle range where the intermediate chamber 14 is communicated with none of the suction port 1*a* and the discharge port 2*c*. Thereafter, the intermediate chamber 14 is communicated with the discharge port 2*c*.

Figure 5:
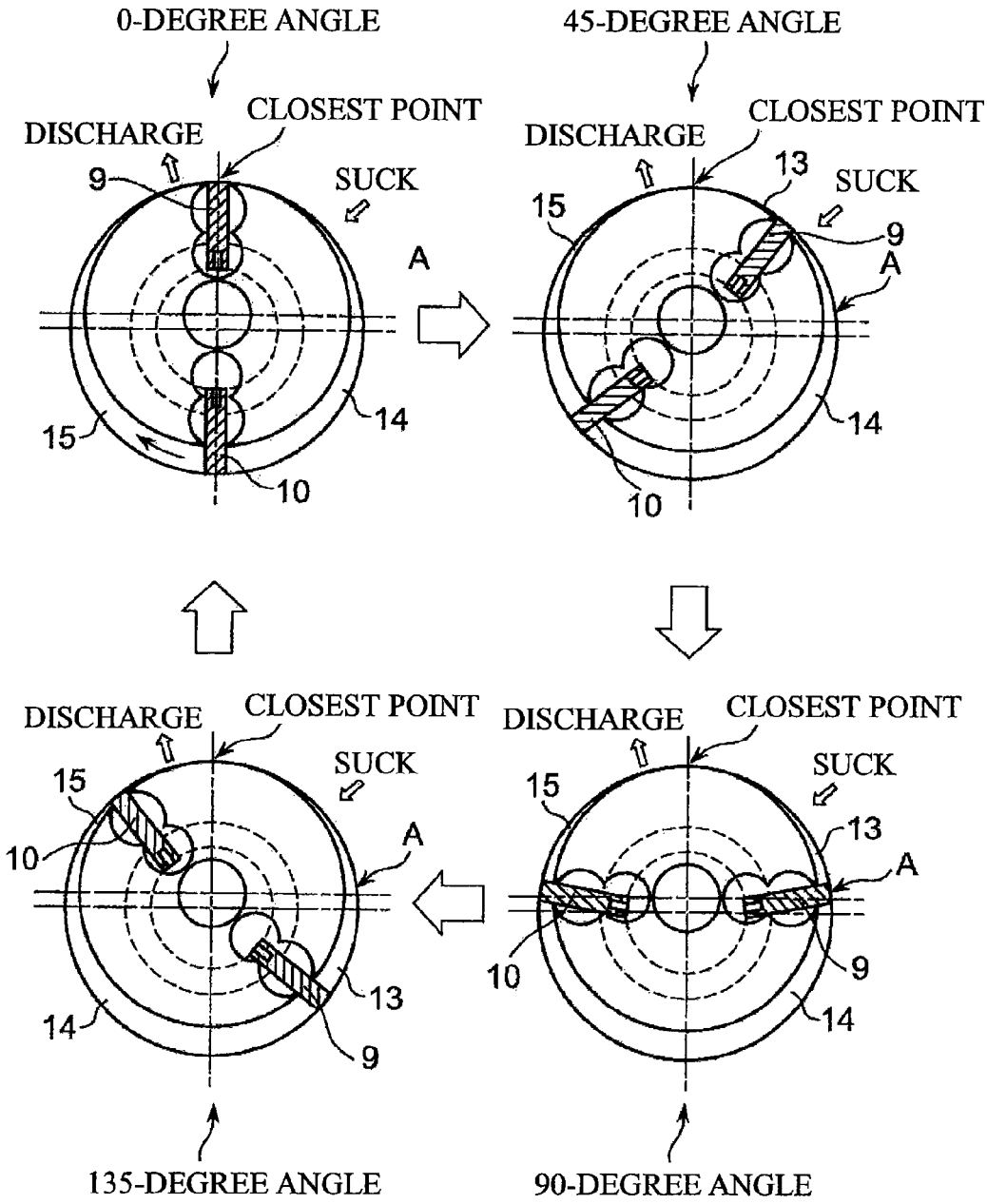
FIG. 5 diagrams showing the first embodiment, which are plan views of the compression element 101 illustrating a compression operation of the vane compressor 200.

FIG. 5 includes diagrams showing the first embodiment. FIG. 5 shows plan views of the compression element 101 illustrating a compression operation of the vane compressor 200. Referring to FIG. 5, a description will be given of how volumes of the suction chamber 13, the intermediate chamber 14, and the compression chamber 15 change along with rotation of the rotor shaft 4. First, referring to FIG. 5, a rotation angle at which the closest point where the rotor portion 4*a* of the rotor shaft 4 and the inner peripheral surface 1*b* of the cylinder 1 are closest (shown in FIG. 4) coincides with the location where the first vane 9 slides on the inner peripheral surface 1*b* of the cylinder 1 is defined as "0-degree angle". FIG. 5 shows positions of the first vane 9 and the second vane 10 at the "0-degree angle", "45-degree angle", the "90-degree angle", and "135-degree angle" and states of the suction chamber 13, the intermediate chamber 14, and the compression chamber 15 at those angles. The single-line arrow shown in the "0-degree angle" diagram of FIG. 5 indicates the rotation direction of the rotor shaft 4 (clockwise direction in FIG. 5). The arrow indicating the rotation direction of the rotor shaft 4 is omitted in the other diagrams. The reason why states at "180-degree angle" and more are not shown is that, at the "180-degree angle", positions of the first vane 9 and the second vane 10 are exchanged from those of the first vane 9 and the second vane 10 at the "0-degree angle", and then the compression operation is performed in the same manner as that at the rotation angles from the "0-degree angle" to the "135-degree angle".

The suction port 1*a* is provided between the closest point and a point A where the tip portion 9*a* of the first vane 9 slides on the inner peripheral surface 1*b* of the cylinder 1 at the "90-degree angle" (e.g., at a location of approximately 45 degrees). The suction port 1*a* opens in the range from the closest point to the point A. The suction port 1*a* is just denoted as "suck" in FIGS. 4 and 5.

The discharge port 2*c* is located in the vicinity of and at a predetermined distance leftward from the closest point where the rotor portion 4*a* of the rotor shaft 4 and the inner peripheral surface 1*b* of the cylinder 1 are closest (e.g., at a location of approximately 30 degrees). The discharge port 2*c* is just denoted as "discharge" in FIGS. 4 and 5.

At the "0-degree angle" in FIG. 5, a right side space closed off by the closest point and the second vane 10 is the intermediate chamber 14 and is communicated with the suction port 1*a* to suck in gas (refrigerant). A left side space closed off by the closest point and the second vane 10 is the compression chamber 15 communicated with the discharge port 2*c*.

At the "45-degree angle" in FIG. 5, a space closed off by the first vane 9 and the closest point is the suction chamber 13. The intermediate chamber 14 closed off by the first vane 9 and the second vane 10 is communicated with the suction port 1*a*, and the volume of the intermediate chamber 14 increases from that at the "0-degree angle". Thus, the intermediate chamber 14 continues to suck in the gas. A space closed off by the second vane 10 and the closest point is the compression chamber 15, and the volume of the compression chamber 15 is reduced from that at the "0-degree angle". The refrigerant is therefore compressed, so that the pressure of the refrigerant gradually increases.

At the "90-degree angle" in FIG. 5, the tip portion 9*a* of the first vane 9 overlaps with the point A on the inner peripheral surface 1*b* of the cylinder 1. Thus, the intermediate chamber 14 is not communicated with the suction port 1*a*. This ends suction of the gas in the intermediate chamber 14. In this state, the volume of the intermediate chamber 14 reaches its approximately maximum level. The volume of the compression chamber 15 is further reduced from that at the "45-degree angle". The refrigerant is therefore compressed, so that the pressure of the refrigerant increases. The volume of the suction chamber 13 increases from that at the "45-degree angle", and the suction chamber 13 continues to suck in the gas.

At the "135-degree angle" in FIG. 5, the volume of the intermediate chamber 14 is reduced from that at the "90-degree angle". The refrigerant is therefore compressed, so that the pressure of the refrigerant increases. The volume of the compression chamber 15 is also reduced from that at the "90-degree angle". The refrigerant is therefore compressed, so that the pressure of the refrigerant increases. The volume of the suction chamber 13 increases from that at the "90-degree angle". The suction chamber 13 therefore continues to suck in the gas.

Then, the second vane 10 approaches the discharge port 2*c*. When the pressure of the compression chamber 15 exceeds the high pressure (including a pressure necessary for opening the discharge valve not shown) of the refrigerating cycle, the discharge valve opens, so that the refrigerant in the compression chamber 15 is discharged in the hermetic container 103.

When the second vane 10 passes by the discharge port 2*c*, a small quantity of the high pressure refrigerant remains (becomes a loss) in the compression chamber 15. Then, when the compression chamber 15 disappears at the "180-degree angle" (not shown), this high pressure refrigerant changes to a low pressure refrigerant in the suction chamber 13. At the "180-degree angle", the suction chamber 13 transitions to the intermediate chamber 14, and the intermediate chamber 14 transitions to the compression chamber 15. The compression operation is thereafter repeated.

As described above, the volume of the suction chamber 13 gradually increases due to rotation of the rotor shaft 4, so that the suction chamber 13 continues to suck in the gas. The suction chamber 13 thereafter transitions to the intermediate chamber 14. The volume of the intermediate chamber 14 gradually increases partway through the process of sucking in the gas, so that the intermediate chamber 14 continues to suck in the gas. Partway through the process of sucking in the gas, the volume of the intermediate chamber 14 reaches its maximum, and then the intermediate chamber 14 is not communicated with the suction port 1*a*. Suction of the gas in the intermediate chamber 14 is then finished. The volume of the intermediate chamber 14 thereafter gradually decreases, so that the gas is compressed. Then, the intermediate chamber 14 transitions to the compression chamber 15. The compression chamber 15 then continues to compress the gas. The gas, which has been compressed to a predetermined pressure, is discharged from a discharge port (e.g., the discharge port 2*c*) formed in the portion of the cylinder 1, the frame 2 or the cylinder head 3 opening to the compression chamber 15.

Figure 6:
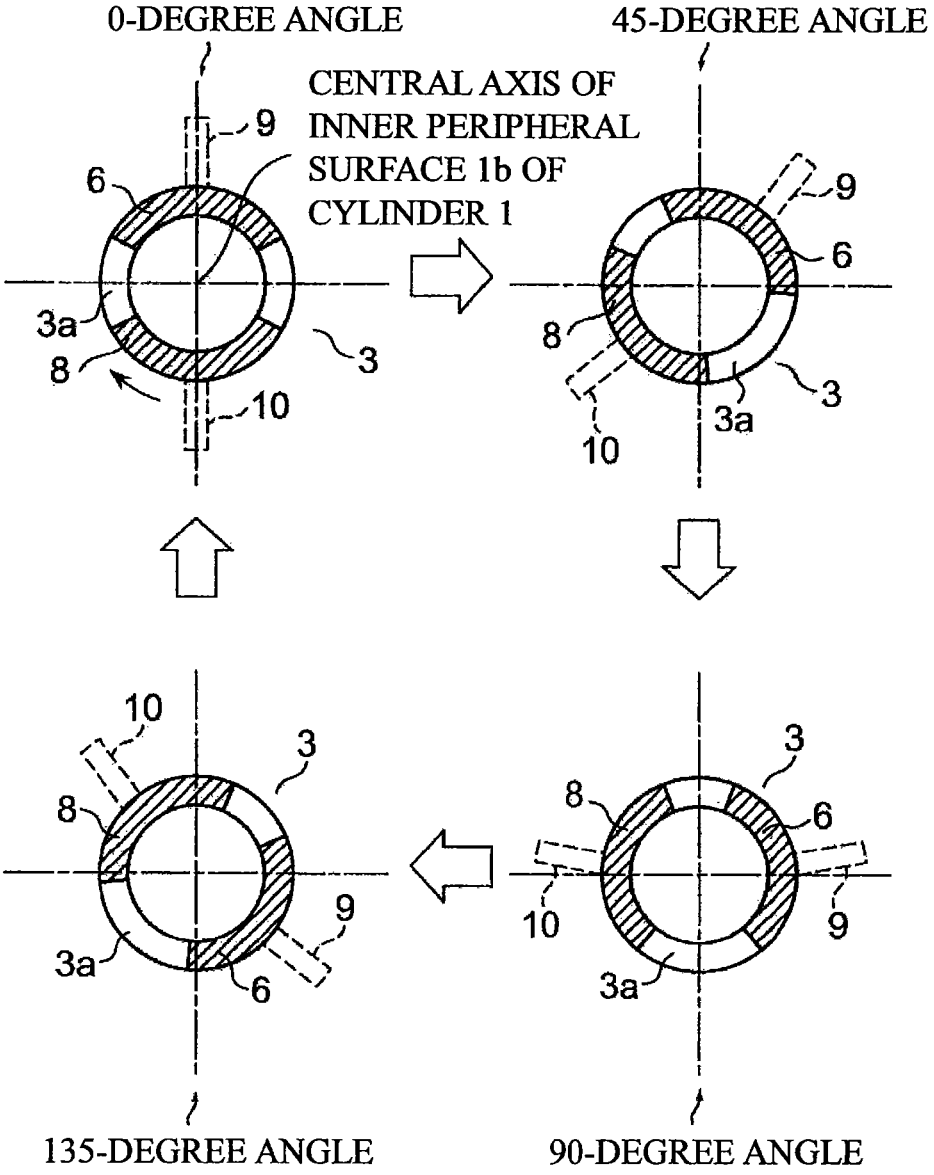
FIG. 6 diagrams showing the first embodiment, which are plan views illustrating rotation operations of the vane aligners 6 and 8 in a vane aligner holding portion 3*a;*

FIG. 6 includes diagrams showing the first embodiment, which are plan views illustrating rotation operations of the vane aligners 6 and 8 in the vane aligner holding portion 3*a*. The single-line arrow shown in the "0-degree angle" diagram of FIG. 6 indicates the rotation direction of the vane aligners 6 and 8 (clockwise direction in FIG. 6). The arrow indicating the rotation direction of the vane aligners 6 and 8 is omitted in the other diagrams. Due to rotation of the rotor shaft 4, the first vane 9 and the second vane 10 rotate about the center of the cylinder 1 (in FIG. 5). The vane aligners 6 and 8 fitted with the first vane 9 and the second vane 10 thereby also rotate about the center of the cylinder 1, in the vane aligner holding portion 3*a*, as shown in FIG. 6. An operation similar to this operation is performed by the vane aligners 5 and 7 as well, which rotate in the vane aligner holding portion 2*a*.

In this embodiment, a mechanism where the first vane 9 and the second vane 10 rotate about the center of the cylinder 1, the mechanism being necessary for performing a compression operation such that the normal to the circular arc formed by each of the tip portion 9*a* of the first vane 9 and the tip portion 10*a* of the second vane 10, and the normal to the inner peripheral surface 1*b* of the cylinder 1 are constantly approximately coincident with each other, is implemented by a structure in which the rotary shaft portions 4*b* and 4*c* are unitarily formed with the rotor portion 4*a*. The mechanism is implemented without using, for the rotor portion 4*a*, end plates that may degrade precision of the outer diameter or the rotation center of the rotor portion 4*a*. Therefore, bearing sliding loss can be reduced by supporting the rotary shaft portions 4*b* and 4*c* by the bearing portions 2*b* and 3*b* each having a small diameter. Further, the precision of the outer diameter or the rotation center of the rotor portion 4*a* is improved. A space formed between the rotor portion 4*a* and the inner peripheral surface 1*b* of the cylinder 1 can be thereby narrowed to reduce gas leakage loss. Thus, there is an effect of obtaining the vane compressor 200 with a high efficiency.

Further, as compared with a conventional common vane compressor, the vane compressor 200 in this embodiment is so configured that the radius of the circular arc formed by each of the tip portion 9*a* of the first vane 9 and the tip portion 10*a* of the second vane 10 is formed to be approximately equal to the radius of the inner peripheral surface 1*b* of the cylinder 1, and that the normal to the circular arc formed by each of the tip portions 9*a* of the first vane 9 and the tip portions 10*a* of the second vane 10 and the normal to the inner peripheral surface 1*b* of the cylinder 1 are coincident with each other. The fluid lubrication state is thereby produced for sliding portions of the tip portions 9*a* and 10*a*. Thus, there are effects that sliding resistances of the tip portions 9*a* and 10*a* are greatly reduced, thereby greatly reducing the sliding loss of the vane compressor 200, and abrasion of the tip portion 9*a* of the first vane 9, the tip portion 10*a* of the second vane 10, and the inner peripheral surface 1*b* of the cylinder 1 can be reduced.

In this embodiment, the vane aligner holding portions 2*a* and 3*a* formed in the frame 2 and the cylinder head 3 are shaped into ring grooves. The vane aligners 5, 6, 7, and 8 slide on cylindrical surfaces on the outer peripheral sides of the ring grooves. The vane aligner holding portions 2*a* and 3*a* therefore do not necessarily need to be in the shape of the ring grooves. The vane aligner holding portions 2*a* and 3*a* may be concave portions with grooves each having an outer diameter substantially equal to the outer diameter of each of the vane aligners 5, 6, 7, and 8.

Though not shown in the drawings, it is also possible to further reduce the sliding resistances of the vane tip portions by applying to the configuration of this embodiment a conventional technique. In this conventional technique, a pressure to be acted on the back side of each vane is controlled, thereby reducing a pressing force between the vane tip portions and the inner peripheral surface of the cylinder.

This embodiment shows a method of restricting the directions of the first vane 9 and the second vane 10 by fitting the vane holding portions 5*a*, 6*a*, 7*a*, and 8*a* of the vane aligners 5, 6, 7, and 8 in the back side grooves 9*b* of the first vane 9 and the back side grooves 10*b* of the second vane 10. The vane holding portions 5*a*, 6*a*, 7*a*, and 8*a*, the back side grooves 9*b* of the first vane 9, and the back side grooves 10*b* of the second vane 10 each include a thin-walled portion.

Since the vane holding portions 5*a*, 6*a*, 7*a*, and 8*a* are the quadrangular plate-like projections as shown in FIG. 2, the vane holding portions 5*a*, 6*a*, 7*a*, and 8*a* themselves are low in strength.

Figure 7:
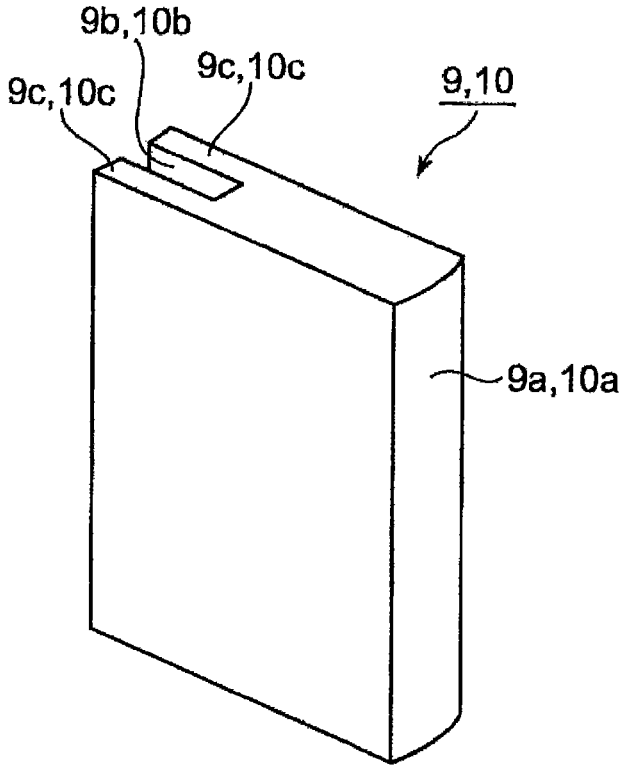
FIG. 7 a diagram showing the first embodiment, which is a perspective view of each of a first vane 9 and a second vane 10.

FIG. 7 is a diagram showing the first embodiment, and is a perspective view of each of the first vane 9 and the second vane 10. The first vane 9 includes thin-walled portions 9*c* at both sides of each back side groove 9*b*. The second vane 10 includes thin-walled portions 10*c* at both sides of each back side groove 10*b*.

Therefore, in order to apply the method of this embodiment, it is preferable that a refrigerant with a small force to be acted on the first vane 9 and the second vane 10, that is, with a low operating pressure be used. The refrigerant with a normal boiling point of minus 45 degrees Celsius or higher, for example, is suitable. The refrigerant such as R600a (isobutane), R600 (butane), R290 (propane), R134a, R152a, R161, R407C, R1234yf, and R1234ze can be used without causing any problem in terms of the strength of the vane holding portions 5*a*, 6*a*, 7*a*, and 8*a*, the back side grooves 9*b* of the first vane 9, and the back side grooves 10*b* of the second vane 10.

Second Embodiment

Figure 8:
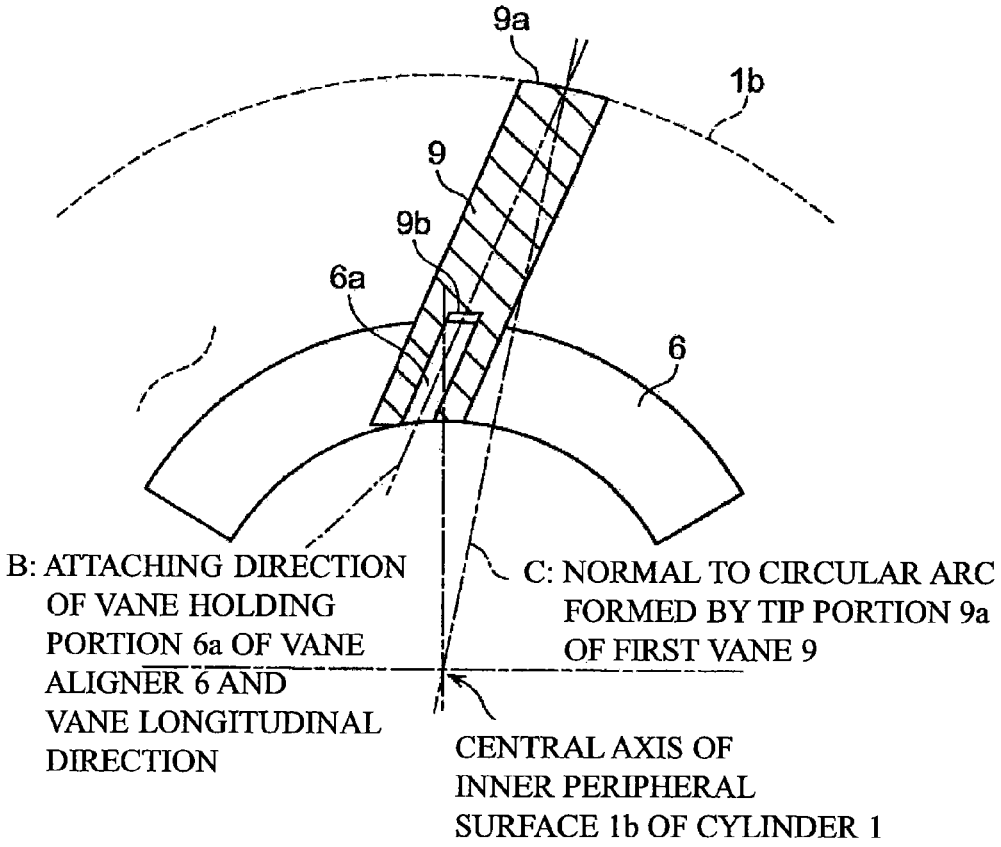
FIG. 8 a diagram showing a second embodiment, which is a sectional view of a state in which the vane aligner 6 is fitted with the first vane 9.

FIG. 8 is a diagram showing a second embodiment, and is a sectional view of a state in which the vane aligner 6 is fitted with the first vane 9. In FIG. 8, B indicates the attaching direction of the vane holding portion 6*a* of the vane aligner 6 and the vane longitudinal direction. C indicates a normal to the circular arc formed by the tip portion 9*a* of the first vane 9. The vane holding portion 6*a* of the vane aligner 6 is attached to an end surface of the partial-ring-shaped component of the vane aligner 6 to be inclined in the direction B. The normal C to the circular arc formed by the tip portion 9*a* of the first vane 9 is inclined from the vane longitudinal direction B. The first vane 9 and the vane aligner 6 are so formed that the normal C is directed to the center of the inner peripheral surface 1*b* of the cylinder 1 while one of the back side grooves 9*b* of the first vane 9 is fitted with the vane holding portion 6*a* of the vane aligner 6. The same configuration as that described above is also applied to the first vane 9 and the vane aligner 5, and is also applied to the second vane 10 and each of the vane aligners 7 and 8.

In the second embodiment described above as well, it is possible to perform the compression operation in the state where the normal to the circular arc formed by each of the vane tip portions (which are the tip portion 9*a* of the first vane 9 and the tip portion 10*a* of the second vane 10) and the normal to the inner peripheral surface 1*b* of the cylinder 1 are constantly coincident with each other during rotation. Thus, an effect similar to that in the first embodiment described above can be obtained. As clear from FIG. 8, the circular arcs formed by the vane tip portions (which are the tip portion 9*a* of the first vane 9 and the tip portion 10*a* of the second vane 10) can be made to be longer than those in the first embodiment. A contact surface pressure between the inner peripheral surface 1*b* of the cylinder 1 and each of the vane tip portions (which are the tip portions 9*a* of the first vane 9 and the tip portion 10*a* of the second vane 10) can be therefore reduced. This makes it possible to further reduce sliding resistances of the vane tip portions (which are the tip portions 9*a* of the first vane 9 and the tip portion 10*a* of the second vane 10).

Third Embodiment

Figure 9:
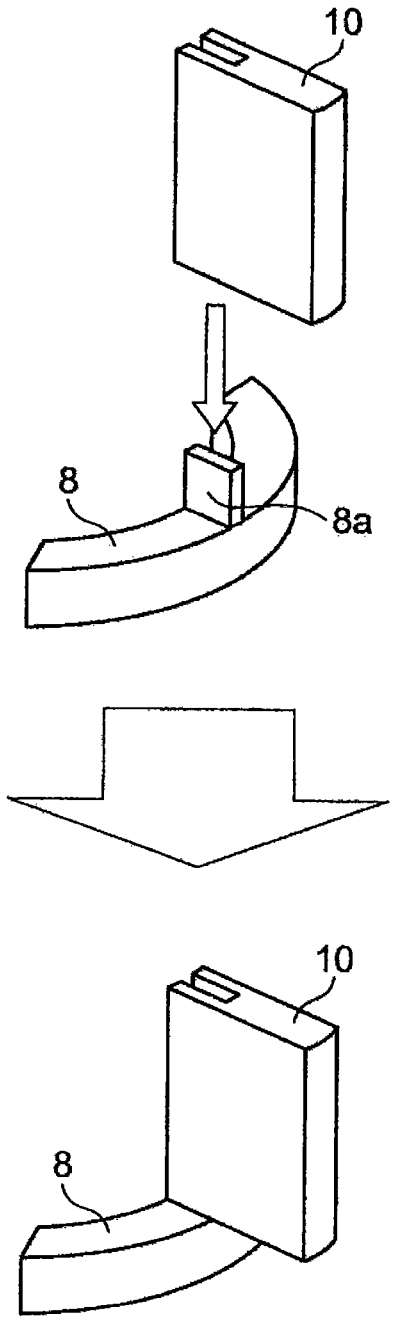
FIG. 9 a diagram showing a third embodiment, which is a diagram showing a structure in which the second vane 10 and the vane aligner 8 are unitarily formed.

FIG. 9 is a diagram showing a third embodiment, and showing a structure in which the second vane 10 and the vane aligner 8 are unitarily formed. FIG. 9 shows the second vane 10 and the vane aligner 8. A relative positional relationship among the back side grooves 9*b* and 10*b* of the vanes, the vane holding portion 5*a* of the vane aligner 5, the vane holding portion 6*a* of the vane aligner 6, the vane holding portion 7*a* of the vane aligner 7, and the vane holding portion 8*a* of the vane aligner 8 does not change during operation of the vane compressor 200 (hermetic type), in the first embodiment described above. Therefore, they (the first vane 9 and each of the vane aligners 5 and 6, and the second vane 10 and each of the vane aligners 7 and 8) can be unitarily formed.

FIG. 9 shows the case where the second vane 10 is unitarily formed with the vane aligner 8. Similarly, the vane aligner 7 may also be unitarily formed with the second vane 10, or may not be unitarily formed with the second vane 10. The second vane 10 is unitarily formed with at least one of the vane aligners 7 and 8. The same also holds true for the first vane 9. The first vane 9 is unitarily formed with at least one of the vane aligners 5 and 6.

Operations will now be described. In the third embodiment, the operations approximately similar to those in the first embodiment are performed. The third embodiment is different from the first embodiment in that the first vane 9 is unitarily formed with at least one of the vane aligners 5 and 6 and the second vane 10 is unitarily formed with at least one of the vane aligners 7 and 8. Movements of the first. vane 9 and the second vane 10 in the rotor normal direction are thereby fixed. Consequently, the tip portion 9*a* of the first vane 9 and the tip portion 10*a* of the second vane 10 do not slide on the inner peripheral surface 1*b* of the cylinder 1, so that the first vane 9 and the second vane 10 rotate without contacting to and with maintaining a minute space from the inner peripheral surface 1*b* of the cylinder 1.

In this embodiment, the tip portion 9*a* of the first vane 9 and the tip portion 10*a* of the second vane 10 are not in contact with the inner peripheral surface 1*b* of the cylinder 1. Consequently, no sliding loss occurs in the vane tip portions (which are the tip portion 9*a* of the first vane 9 and the tip portion 10*a* of the second vane 10). A force to act on sliding portions of the vane aligners 5, 6, 7 and 8 and the vane aligner holding portions 2*a* and 3*a* increases correspondingly. However, these sliding portions are in the fluid lubrication state. In addition, a sliding distance of each of the sliding portions of the vane aligners 5 and 6 and the vane aligners 7 and 8 and a corresponding one of the vane aligner holding portions 2*a* and 3*a* is shorter than a sliding distance of each of the vane tip portions (which are the tip portion 9*a* of the first vane 9 and the tip portion 10*a* of the second vane 10). Thus, there is an effect of further reducing sliding loss from that in the first embodiment.

Though not illustrated in the third embodiment as well, it may be so arranged that only the normal to the circular arc formed by each of the vane tip portions (which are the tip portion 9*a* of the first vane 9 and the tip portion 10*a* of the second vane 10) and the normal to the inner peripheral surface 1*b* of the cylinder 1 are substantially coincident with each other and that the vane longitudinal direction has a fixed inclination with respect to the normal direction of the inner peripheral surface 1*b* of the cylinder 1, as in the second embodiment. With this arrangement, the length of the circular arc formed by each of the vane tip portions (which are the tip portions 9*a* of the first vane 9 and the tip portion 10*a* of the second vane 10) can be increased. A resulting increase in seal length makes it possible to further reduce leakage loss at each of the vane tip portions (which the tip portion 9*a* of the first vane 9 and the tip portion 10*a* of the second vane 10).

Fourth Embodiment

Figure 10:
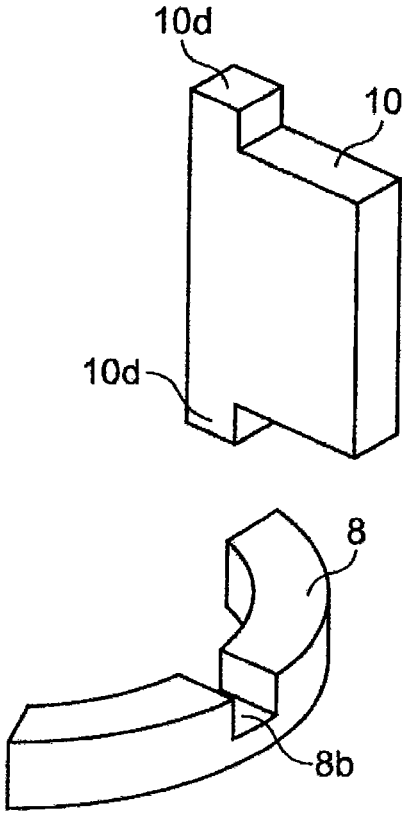
FIG. 10 a diagram showing a fourth embodiment, which is a perspective view of the second vane 10 and the vane aligner 8.

FIG. 10 is a diagram showing a fourth embodiment, and is a perspective view of the second vane 10 and the vane aligner 8. FIG. 10 shows the second vane 10 and the vane aligner 8. In comparison with the first embodiment, projecting portions 10*d* are provided at the second vane 10, in place of the back side grooves 10*b*. A slit-like vane holding groove 8*b* is provided in the vane aligner 8, in place of the vane holding portion 8*a*, which is the plate-like projection. Though not illustrated, similarly, a slit-like vane holding groove 7*b* is provided in the vane aligner 7, in place of the vane holding portion 7*a*. Then, the projecting portions 10*d* provided at the end surfaces of the second vane 10 are fitted in the vane holding grooves 7*b* and 8*b*, thereby restricting the direction such that the normal to the circular arc formed by the tip portion 10*a* of the second vane 10 and the normal to the inner peripheral surface 1*b* of the cylinder 1 are constantly coincident with each other.

Alternatively, excessive movement of the second vane 10 in a direction opposite to the side of the inner peripheral surface 1*b* of the cylinder 1 may be restricted by closing, instead of opening, each of the vane holding groove 7*b* of the vane aligner 7 and the vane holding groove 8*b* of the vane aligner 8 on the internal diameter side. The same configuration may also be applied to the first vane 9 and the vane aligners 5 and 6. An effect similar to that in the first embodiment can be obtained in the above-mentioned configuration as well.

In the fourth embodiment as well, the first vane 9 may be unitarily formed with at least one of the vane aligners 5 and 6. Alternatively, the second vane 10 may be unitarily formed with at least one of the vane aligners 7 and 8. An effect similar to that in the third embodiment can be obtained.

Projecting portions (projecting portions (not shown) of the first vane 9 or the projecting portions 10*d* of the second vane 10) provided at the end surfaces of the vane (the first vane 9 or the second vane 10) may be attached to the vane (the first vane 9 or the second vane 10) to be inclined, and only the normal to the circular arc formed by the vane tip portion (the tip portion 9*a* of the first vane 9 or the tip portion 10*a* of the second vane 10) may be made to coincide with the normal direction of the inner peripheral surface 1*b* of the cylinder 1. With this configuration, the effect similar to that in the second embodiment can be obtained.

For each of the first to fourth embodiments, the case where the number of the vanes is two is shown. The first to fourth embodiments may be similarly configured even when the number of the vanes is three or more, and effects similar to those in the first to fourth embodiments can be obtained.

REFERENCE SIGNS LIST

1: cylinder
1*a*: suction port
1*b*: inner peripheral surface
2: frame
2*a*: vane aligner holding portion
2*b*: bearing portion
2*c*: discharge port
3: cylinder head
3*a*: vane aligner holding portion
3*b*: bearing portion
4: rotor shaft
4*a*: rotor portion
4*b*: rotary shaft portion
4*c*: rotary shaft portion
4*d*: bush holding portion
4*e*: bush holding portion
4*f*: vane relief portion
4*g*: vane relief portion
5: vane aligner
5*a*: vane holding portion
6: vane aligner
6*a*: vane holding portion
7: vane aligner
7*a*: vane holding portion
7*b*: vane holding groove
8: vane aligner
8*a*: vane holding portion
8*b*: vane holding groove
9: first vane
9*a*: tip portion
9*b*: back side groove
9*c*: thin-walled portion
10: second vane
10*a*: tip portion
10*b*: back side groove
10*c*: thin-walled portion
10*d*: projecting portion
11: bush
12: bush
13: suction chamber
14: intermediate chamber
15: compression chamber
21: stator
22: rotor
23: glass terminal
24: discharge pipe
25: refrigerant oil
26: suction portion
101: compression element
102: electric motor element

103: hermetic container
200: vane compressor
The invention claimed is:
1. A vane compressor comprising:
a cylinder;
a frame that closes one axial end of the cylinder;
a cylinder head that closes the other axial end of the cylinder;
a rotor shaft including a rotary shaft portion supported by the frame and the cylinder head and being eccentric to a center of an inner peripheral surface of the cylinder, and a rotor portion that rotates about the rotary shaft portion in the cylinder;
a plurality of vanes installed in the rotor portion, each of the plurality of vanes including a tip portion that moves in the cylinder along with rotation of the rotor portion; and
vane aligners attached respectively to an end surface of each of the frame and the cylinder head on a side of the cylinder to rotate about an axis concentric with the inner peripheral surface of the cylinder, the vane aligners supporting the plurality of vanes, and a minute space is maintained between the tip portion of each of the plurality of vanes and the inner peripheral surface of the cylinder, wherein
a bush holding portion penetrating axially is formed in the rotor portion,
the vane compressor further comprising a pair of approximately semicolumnar bushes inserted in the bush holding portion to support the plurality of vanes by sandwiching the plurality of vanes, wherein
the vane aligners support the plurality of vanes such that the plurality of vanes are rotatable about a central axis of the bush holding portion.
2. The vane compressor according to claim 1, wherein
a concave portion whose inner peripheral surface is concentric with the inner peripheral surface of the cylinder is formed in the end surface of each of the frame and the cylinder head on the side of the cylinder, and
each of the vane aligners is provided to slide along the inner peripheral surface of the concave portion of a respective one of the frame and the cylinder head.
3. The vane compressor according to claim 2, wherein
the concave portion of each of the frame and the cylinder head is a ring-shaped groove.
4. The vane compressor according to claim 1, wherein
each of the vane aligners is unitarily attached to one of the plurality of vanes, or each of the vane aligners is unitarily formed with one of the plurality of vanes.
5. The vane compressor according to claim 1, wherein
the tip portion of each of the plurality of vanes is a longitudinal tip portion of each of the plurality of vanes, and
the vane aligners support the plurality of vanes such that each of the plurality of vanes is movable in a direction perpendicular to a longitudinal dimension of the rotor shaft.
6. The vane compressor according to claim 1, wherein
the vane aligners support the plurality of vanes such that the plurality of vanes are rotatable with respect to the rotor portion.
7. The vane compressor according to claim 1, wherein
an outer peripheral surface of the tip portion of each of the plurality of vanes is formed to curve into a circular arc shape having approximately a same radius as the inner peripheral surface of the cylinder.
8. The vane compressor according to claim 1, wherein
an outer peripheral surface of each of the vane aligners is formed to curve into a circular arc shape.
9. The vane compressor according to claim 8, wherein
each of the vane aligners is partial-ring-shaped.
10. The vane compressor according to claim 1, the vane compressor compressing a refrigerant having a normal boiling point of minus 45 degrees Celsius or higher.
11. The vane compressor according to claim 1, wherein
the bush holding portion having an approximately circular cross-section and penetrating in an axial direction is formed in a vicinity of an outer peripheral portion of the rotor portion,
each of the plurality of vanes is supported through a pair of approximately semicolumnar bushes in the bush holding portion so as to be rotatable and movable with respect to the rotor portion in the rotor portion, and
a vane relief portion communicating with the bush holding portion and penetrating in the axial direction is provided in the rotor portion, so as to prevent a back side of each of the plurality of vanes opposite to the inner peripheral surface of the cylinder from contacting the rotor portion.
12. A vane compressor comprising:
a cylinder;
a frame that closes one axial end of the cylinder;
a cylinder head that closes the other axial end of the cylinder;
a rotor shaft including a rotary shaft portion supported by the frame and the cylinder head and being eccentric to a center of an inner peripheral surface of the cylinder, and a rotor portion that rotates about the rotary shaft portion in the cylinder;
a plurality of vanes installed in the rotor portion, each of the plurality of vanes including a tip portion that moves in the cylinder along with rotation of the rotor portion; and
vane aligners attached respectively to an end surface of each of the frame and the cylinder head on a side of the cylinder to rotate about an axis concentric with the inner peripheral surface of the cylinder, the vane aligners supporting the plurality of vanes, and a minute space is maintained between the tip portion of each of the plurality of vanes and the inner peripheral surface of the cylinder, wherein
a bush holding portion having an approximately circular cross-section and penetrating in an axial direction is formed in a vicinity of an outer peripheral portion of the rotor portion,
each of the plurality of vanes is supported through a pair of approximately semicolumnar bushes in the bush holding portion so as to be rotatable and movable with respect to the rotor portion in the rotor portion, and
a vane relief portion communicating with the bush holding portion and penetrating in the axial direction is provided in the rotor portion, so as to prevent a back side of each of the plurality of vanes opposite to the inner peripheral surface of the cylinder from contacting the rotor portion.
13. A vane compressor comprising:
a cylinder;
a frame that closes one axial end of the cylinder;
a cylinder head that closes the other axial end of the cylinder;
a rotor shaft including a rotary shaft portion supported by the frame and the cylinder head and being eccentric to a center of an inner peripheral surface of the cylinder, and a rotor portion that rotates about the rotary shaft portion in the cylinder;
a plurality of vanes installed in the rotor portion, each of the plurality of vanes including a tip portion that moves in the cylinder along with rotation of the rotor portion; and vane aligners attached respectively to an end surface of each of the frame and the cylinder head on a side of the cylinder to rotate about an axis concentric with the inner peripheral surface of the cylinder, the vane aligners supporting the plurality of vanes, and a minute space is maintained between the tip portion of each of the plurality of vanes and the inner peripheral surface of the cylinder, wherein the vane aligners support the plurality of vanes such that the plurality of vanes are rotatable with respect to the rotor portion.

* * * * *